United States Patent [19]

Achter et al.

[11] Patent Number: 4,987,341

[45] Date of Patent: Jan. 22, 1991

[54] FLASH LAMP WITH METAL COATING ON AN OUTER END OF AN ELECTRODE THEREOF

[75] Inventors: Eugen Achter, Trebur; Ingo Duenisch; Michael Lausch, both of Taunusstein, all of Fed. Rep. of Germany

[73] Assignee: Heimann GmbH, Wiesbaden, Fed. Rep. of Germany

[21] Appl. No.: 518,245

[22] Filed: May 7, 1990

Related U.S. Application Data

[63] Continuation-in-part of Ser. No. 403,049, Sep. 1, 1989, abandoned, which is a continuation of Ser. No. 146,100, Jan. 20, 1988, abandoned.

[30] Foreign Application Priority Data

Jan. 23, 1987 [DE] Fed. Rep. of Germany ..... 8701119

[51] Int. Cl.[5] ..... H01J 61/30; H01J 61/36

[52] U.S. Cl. ..... 313/623; 313/635; 313/331

[58] Field of Search ..... 313/623, 624, 625, 634, 313/635, 318, 331

[56] References Cited

U.S. PATENT DOCUMENTS

| | | | |
|---|---|---|---|
| 2,624,023 | 12/1952 | Noel et al. | 313/594 |
| 3,534,213 | 10/1970 | Simon et al. | 313/634 X |
| 3,693,007 | 9/1972 | Kerekes | 313/623 X |
| 3,900,754 | 8/1975 | Mason et al. | 313/635 |
| 3,906,273 | 9/1975 | Kozlowski | 313/634 X |
| 4,236,045 | 11/1980 | van den Plas et al. | 313/331 X |
| 4,672,268 | 6/1987 | Deunisch et al. | 313/633 |
| 4,827,189 | 5/1989 | Achter et al. | 313/623 |

FOREIGN PATENT DOCUMENTS

| | | |
|---|---|---|
| 3329270 | 4/1985 | Fed. Rep. of Germany . |
| 435527 | 12/1933 | United Kingdom . |

OTHER PUBLICATIONS

"Designers Handbook, Light Source Applications" by J. F. Waymouth et al, GTE Products Corp., 12-1980, pp. 57 and 58.

"Reference Data for Radio Engineers", Fourth Edition, by International Telephone and Telegraph Corp., 12-1961, pp. 48, 49.

*Primary Examiner*—Palmer C. DeMeo

*Attorney, Agent, or Firm*—Hill, Van Santen, Steadman & Simpson

[57] ABSTRACT

A flash lamp which has two electrodes of refractory metal fused into a glass housing. In order to enable a soft-soldered connection, the outer end of the electrodes is respectively connected to a soft-solderable metal coating.

7 Claims, 1 Drawing Sheet

FLASH LAMP WITH METAL COATING ON AN OUTER END OF AN ELECTRODE THEREOF

This is a continuation-in-part of application Ser. No. 403,049 filed Sept. 1, 1989, now abandoned, which is a continuation of Ser. No. 146,100 filed Jan. 20, 1988, now abandoned.

BACKGROUND OF THE INVENTION

The present invention is directed to a flash lamp having a tubular, closed glass housing at whose opposite ends electrodes of refractory metal are fused therein.

Flash lamp of this type are known wherein the electrodes are formed of tungsten pins that have their outer ends connected to soft-solderable metal pins by electrical resistance welding. Lead wires can then be soldered to the metal pins with soft solder. However, the welding of the soft-solderable metal pins involves a considerable outlay in terms of production engineering.

It is also known for flash lamps of the type intially cited to coat the end faces of the electrodes with a soft-solderable hard solder in order to connect the lead wires by soft-soldering. Although the production-engineering outlay required in order to provide the electrodes with a soft-solderable connection is low in this case, it is difficult to solder the lead wires to the end faces of the electrodes which often exhibit a diameter of only one millimeter or less.

SUMMARY OF THE INVENTION

An, object of the present invention is to provide a flash lamp of the type initially cited such that the production-engineering outlay for creating a soft-solderable connecting location for the electrodes is low and the soldered connection of the lead wires to the electrodes can be provided in a simple manner.

This object is inventively achieved in that at least one electrode has its outer end projecting out of the glass housing and has at least the generated surface of its outer end surrounded by a soft-solderable metal layer. The metal layer can thereby be formed of a soft-solderable hard solder or by a thin metal coating. The production-engineering outlay for manufacturing the metal layer is low. Further, the solder connection between the electrode and the lead wire can be produced in a simple manner since, due to the fact that the outer end of the electrode is provided with the metal layer at its generated surface, an adequately large soldering area is available even when the electrode only exhibits a very small diameter.

the term "soft-solderable metal layer" is herein defined to be a metal layer, such as pure copper, which can bond with a soft solder. Any standard commercial soft solder can be utilized with the present invention. Since the metal layer can bond with the soft solder, it is referred to as being "soft-solderable".

Another inventive solution of the stated object provides that at least one electrode has its outer end terminating approximately flush with the glass housing. The region of the glass housing surrounding the outer end of the electrode is provided with a soft-solderable metal layer which is connected in an electrically conductive fashion to the electrode. Here, too an adequately large soldering area to which the lead wire can be soldered to is present as a consequence of the metal layer which can be formed either by a metal disk surrounding the outer end of the electrode coaxially and connected thereto in an electrically conductive fashion or by a thin metal coating which also covers the outer end of the electrode. Further, the metal layer can be manufactured with a low production-engineering outlay.

The materials which may be utilized in the present invention regarding the components of the flash lamp are disclosed, for example, in U.S. Pat. No. 4,827,189 (hereby incorporated by reference).

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures in which like reference numerals identify like elements, and in which:

DESCRIPTION OF THE PREFERRED EMBODIMENTS

Figure 1:
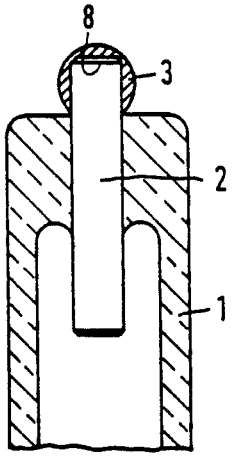
FIGS. 1 through 4 are cross-sectional views which show one end of a flash lamp which has a tubular glass housing of hard glass in which two electrodes are fused at either ends, only one electrode thereof being shown in FIGS. 1 through 4.

In the exemplary embodiment of FIG. 1, an electrode 2 has its outer end 8 projecting out of the housing 1 and is surrounded by a hard solder 3 which allows a soft-soldered connection to a lead wire (not shown).

Figure 2:
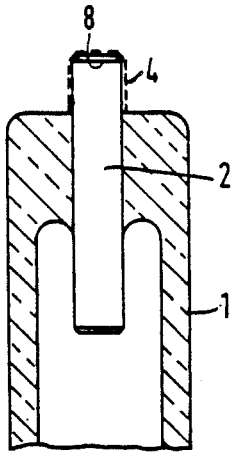

In the example of FIG. 2, a metal coating 4 is provided at the outer end 8 of the electrode 2 instead of the hard solder 3 in FIG. 1. Both this metal coating 4 as well as the hard solder 3 are soft-solderable. The metal coating 4 can be vapor-deposited, sputtered on, galvanically applied or sprayed on.

Figure 3:
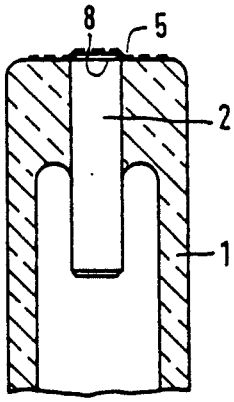

FIG. 3 shows a flash lamp wherein the outer end 8 of the electrode 2 terminates approximately flush with the glass housing 1. It is coated by a metal coat 5 of soft-solderable metal which also covers the glass. The metal coating 5 can be sputtered on or sprayed on.

Figure 4:
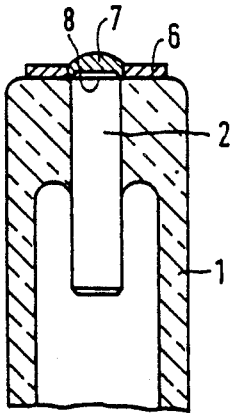

In the example of FIG. 4, the end 8 of the electrode 2 likewise terminating flush with the glass housing 1 is surrounded by a metal disk 6 of soft-solderable material which is connected to the outer end 8 of the electrode 2 in an electrically conductive fashion with the assistance of a hard solder 7.

What the examples of FIGS. 1 and 2 have in common is that the metal layer that is formed by the hard solder 3 or, respectively, by the metal coating 4 surrounds the electrode end 8 projecting out of the glass housing 1. What the embodiments of the FIGS. 3 and 4 have in common is that the outer electrode end 8 terminates approximately flush with the glass housing 1. The end 8 is coated with a metal layer which is formed by the metal coating 5 in the embodiment of FIG. 3 and is formed by the metal disk 6 in the embodiment of FIG. 4 which is connected to the electrode 2 by the hard solder 7.

The following sets forth the types of solders useable with the present invention. The hard solder 3 depicted in FIG. 1 and the solder 7 in FIG. 4 can be one of the following, for example, pure copper, a copper/silver alloy, a copper/nickel alloy or pure nickel. The metal coating 4 in FIG. 2 and the metal coating 5 in FIG. 3 can be, for example, pure copper, double layer chromium/copper or double layer chromium/nickel. The metal disc 6 in FIG. 4 can be, for example, pure nickel, an iron/nickel alloy or an iron/cobalt/nickel alloy (known as KOVAR).

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A flash lamp having a tubular, closed glass housing at whose opposite ends electrodes of refractory metal are fused therein, comprising at least one electrode having an outer end terminating approximately flush with the glass housing and the glass housing having a region surrounding the outer end of the electrode provided with a first soft-solderable metal coating which is conductively connected to the electrode, the outer end of the electrode being covered by a second soft-solderable metal coating.

2. A flash lamp according to claim 1, wherein the first soft-solderable metal coating is formed of a soft-solderable hard solder.

3. A flash lamp having a tubular, closed glass housing at whose opposite ends electrodes of refractory metal are fused therein, comprising at least one electrode having an outer end terminating approximately flush with the glass housing and the glass housing having a region surrounding the outer end of the electrode provided with a soft-solderable metal coating which is conductively connected to the electrode, the metal coating being formed by a metal disk coaxially surrounding the outer end of the electrode, the metal disk being connected to the outer end of the electrode with hard solder.

4. A flash lamp having a tubular, closed glass housing at whose opposite ends electrodes of refractory metal are fused therein, comprising at least one electrode having an outer end termination approximately flush with the glass housing and the glass housing having a region surrounding the outer end of the electrode provided with a soft-solderable metal coating which is conductively connected to the electrode, the metal coating being formed by a thin metal coat which also covers the outer end of the electrode.

5. A flash lamp according to claim 4, wherein the thin metal coat is produced by sputtering.

6. A flash lamp according to claim 4, wherein the thin metal coat is produced by spraying.

7. A flash lamp having a tubular, closed glass housing at whose opposite ends electrodes of refractory metal are fused therein, comprising at least one electrode having an outer end extending through the housing and a soft-solderable metal coating conductively connected to and substantially covering the outer end of the electrode, said outer end of said electrode being approximately flush with the glass housing and the glass housing having a region surrounding the outer end of the electrode provided with the metal coating.

* * * * *